US005845881A

United States Patent [19]

Young et al.

[11] Patent Number: 5,845,881

[45] Date of Patent: Dec. 8, 1998

[54] RAILROAD TRACKWORK INTERSECTIONS

[75] Inventors: Keith Young, Naperville, Ill.; Stephen R. Kuhn, Richton Park, Ill.; Joan Q. Xia, River Forest, Ill.; Thomas S. Baker, Jr., Columbus, Ohio

[73] Assignee: ABC Rail Products Corporation, Chicago, Ill.

[21] Appl. No.: 920,777

[22] Filed: Aug. 29, 1997

[51] Int. Cl.[6] ..... E01B 7/00

[52] U.S. Cl. ..... 246/457; 246/458; 246/463; 246/465; 246/468

[58] Field of Search ..... 246/375, 454, 246/455, 456, 457, 458, 460, 462, 463, 465, 466, 467, 468, 469, 470, 471, 472

[56] References Cited

U.S. PATENT DOCUMENTS

| | | | |
|---|---|---|---|
| 758,964 | 5/1904 | Green | 246/457 |
| 1,249,981 | 12/1917 | Malloch | 246/457 |
| 1,251,123 | 12/1917 | Smith | 246/457 |
| 1,258,670 | 3/1918 | Gordon | 246/457 |
| 2,214,489 | 9/1940 | Strickland et al. | 246/457 |
| 2,361,873 | 10/1944 | Rosebrook et al. | 246/457 |
| 5,746,400 | 5/1998 | Remington et al. | 246/465 |

*Primary Examiner*—Mark Tuan Le
*Attorney, Agent, or Firm*—Thomas S. Baker, Jr.

[57] ABSTRACT

A railroad trackwork intersection assembly such as a crossing intersection or a turnout intersection is provided with at least one flange-bearing frog subassembly which has railcar wheel flangeways of uniform depth throughout the frog planform that co-operate with trackwork traffic rails, with easer subassemblies that are positioned exterior to but abut the frog subassembly, that have sloping flange support surfaces, and that may be removed from or adjusted in the assembly without moving or adjusting either the frog subassembly or the co-operating trackwork traffic rails.

11 Claims, 5 Drawing Sheets

RAILROAD TRACKWORK INTERSECTIONS

CROSS-REFERENCES

None.

FIELD OF THE INVENTION

This invention relates generally to railroad trackwork intersections such as railroad trackwork crossing intersections and railroad trackwork turnout intersections, and more particularly concerns railroad trackwork crossing and turnout intersections of the type having flange-bearing railcar wheel flangeways.

BACKGROUND OF THE INVENTION

Increasingly, the operators of modern, heavy-duty rail transportation systems (high train speeds, high railcar axle loadings, and high railcar traffic densities) are adopting railroad trackwork improvements that especially offer advantages of prolonged operating life and a consequent reduction of trackwork maintenance costs. One such railroad trackwork improvement involves replacing trackwork intersections that are characterized as railcar wheel tread-bearing with intersections classified as being flange-bearing. For an example of one known flange-bearing type of railroad intersection refer to U.S. Pat. No. 5,531,409 granted to Willow for flange bearing bolted rail frog railroad turnouts and crossings.

Flange-bearing frogs function to prevent the tread surfaces of railcar wheels passing through the intersection from impacting and damaging the corners of the flangeway gaps typically provided at the intersection traffic rails to eliminate the physical interferences that otherwise would occur with respect to the wheel flanges of railcars crossing the intersection in a differently angled direction. The damage prevention is accomplished by causing the railcars passing through the frog in a particular direction to be elevated sufficiently to transfer railcar weight from the railcar wheel tread to the railcar wheel flange at the location of each traffic rail section flangeway gap. The conventional intersection flange-bearing frog assembly of U.S. Pat. No. 5,531,409, for instance, utilizes relatively short easer ramps that are integrally machined into the frog assembly manganese steel casting filler component to achieve the desired railcar wheel elevation and weight transfer objectives.

We have discovered a railroad trackwork flange-bearing intersection construction that differs significantly from the prior art flange-bearing frog assembly, and that, because of the resulting significantly reduced railcar wheel impact loadings (relative to equal railcar weights and railcar velocities), obtains materially increased intersection operating lifetimes. Also, and as a consequence of the invention, important reductions of intersection maintenance costs for repair or replacement are obtained. Such cost reductions are especially important to railroad transportation system operators that utilize the improved intersection construction in connection with applications involving high-speed, heavy-duty, and high-density railcar traffic railroad operating conditions.

Other advantages and objects of the present invention will become apparent from careful consideration of the detailed descriptions, drawings, and claims which follow.

SUMMARY OF THE INVENTION

The railroad trackwork invention of this patent application is essentially comprised of an intersection subassembly having railcar wheel flangeway flange-bearing support surfaces of uniform elevation throughout the planform extent of the intersection, railroad trackwork traffic rails co-operating with the intersection subassembly in a fixed abutting relation, and sloped easer subassemblies fixedly positioned adjacent and along the traffic rails and in aligned and abutting relation relative to the intersection subassembly flangeway flange-bearing support surfaces.

In the case of a railroad trackwork crossing application, the intersection subassembly is basically comprised of four flange-bearing frog assemblies of uniform flangeway depth throughout their planform extent, of eight trackwork traffic rails leading to and/or from the intersection subassembly, and of eight sloped easer subassemblies co-operating with the intersection subassembly and with the traffic rails. Four filler sections that each have a railcar wheel flangeway flange-bearing support surface of uniform corresponding elevation may be advantageously and necessarily or optionally included in the intersection subassembly to interconnect the four frog assemblies in co-operating relation depending on intersection subassembly design particulars.

In the case of a railroad trackwork turnout intersection application the intersection subassembly is basically comprised of a single flange-bearing frog assembly of uniform flangeway depth throughout its planform extent, of four trackwork traffic rails leading to and/or from the intersection subassembly, and of four sloped easer subassemblies co-operating with the intersection subassembly and with the traffic rails. Additionally, two easer subassemblies and an intermediate longitudinal track filler section are preferably positioned along each trackwork outboard mainline or turnout traffic rail to assure vertical stability for each railcar passing through the intersection subassembly. The intermediate longitudinal filler sections each have a railcar wheel flangeway flange-bearing support surface of corresponding uniform elevation.

Also, the easer subassemblies incorporated into the novel railroad trackwork, as well as the included trackwork filler sections, additionally advantageously perform a guardrail function.

DETAILED DESCRIPTION

Figure 1:
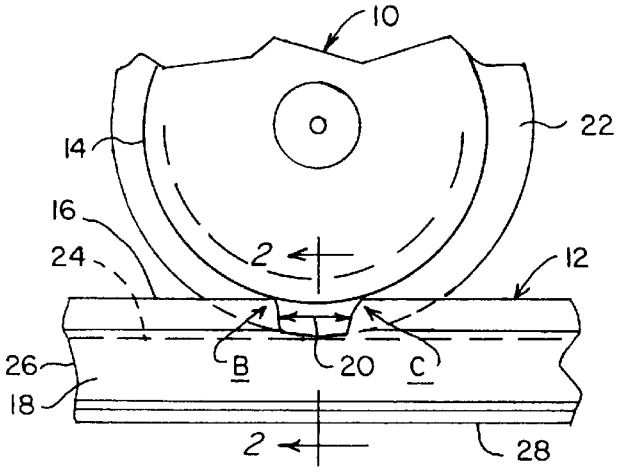
FIG. 1 PRIOR ART
FIG. 1 is an elevation view of a portion of a prior art tread-bearing type of railroad trackwork frog assembly and a superimposed railcar wheel passing over the assembly.
Figure 2:
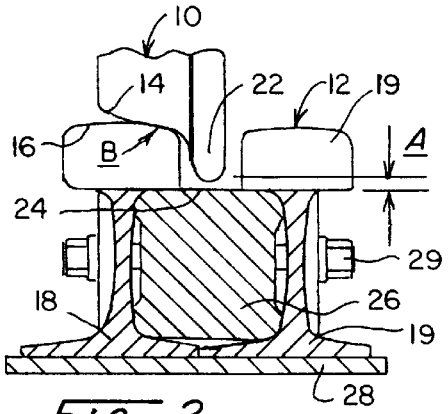
FIG. 2 PRIOR ART
FIG. 2 is a section view taken at line 2—2 of FIG. 1.

In FIGS. 1 and 2 we schematically illustrate the positional relationships of a railroad railcar wheel 10 passing through a portion of a prior art tread-bearing frog subassembly 12 typically included in either a conventional railroad trackwork crossing intersection or a conventional railroad trackwork turnout intersection. The tread surface 14 of railcar wheel 10 normally rolls upon the crowned top surface 16 of the head of trackwork traffic rail 18 (or traffic rail 19 if crossing in an intersecting direction) except when wheel 10 is crossing the gap 20 that is provided in frog assembly 12 to avoid physical interferences between rail 18 and the wheel flanges 22 that otherwise occur when railcars cross frog assembly 12 along an intersecting direction. In applicable American Railroad Engineering Association (AREA) standards for conventional tread-bearing frog assemblies, a nominal clearance A of at least approximately one-inch exists between the flange 22 of railcar wheel 10 and the upper surface 24 of frog filler element 26. (See FIG. 2). As previously suggested, large impact loads repeatedly imposed upon traffic rail 18 at crowned rail head areas B and C (FIG. 1) by the wheel tread surfaces 14 of numerous railcar wheels 10 traversing the intersecting flangeway gap 20 can result in major damage to the traffic rail and even to the traversing railcar wheels. A base plate element 28 and a threaded bolt fastener 29 are also illustrated in FIG. 2.

Figure 4:
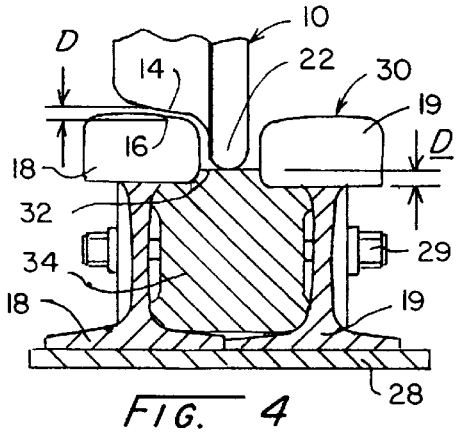
FIG. 4 PRIOR ART
FIG. 4 is a section view taken at line 4—4 of FIG. 3.
Figure 3:
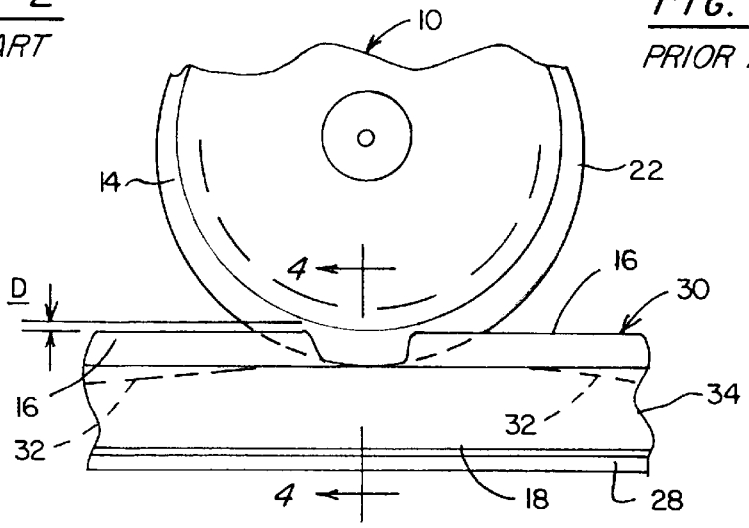
FIG. 3 PRIOR ART
FIG. 3 is an elevation view of a portion of a prior art flange-bearing type of railroad trackwork frog assembly and a superimposed railcar wheel passing through the assembly.

A representative prior art flange-bearing type of railroad trackwork intersection frog subassembly offered to the rail transportation industry to eliminate the type of traffic rail head damage mentioned above is schematically illustrated in the drawings (FIGS. 3 and 4) and is referenced by the numeral 30. The illustrated frog assembly and railcar wheel components of FIGS. 3 and 4 are generally the same as the corresponding components of FIGS. 1 and 2 except with respect to the uppermost surface 32 of frog filler element 34. That filler element upper surface is a bi-directionally sloping surface integrally machined into filler element 34 in a manner such that its relatively short elevation apex occurs at the region of rail gap 20, and such functions to elevate superimposed railcar wheels through a distance D which is approximately equal to the clearance distance A of frog assembly filler element 26 discussed in connection with FIGS. 1 and 2 of the drawings. As a consequence, bi-directionally sloping filler element upper surface 32 becomes a flange-bearing support surface in the region of flangeway gap 20; the transition of wheel 10 between being tread-supported or being flange-supported basically occurs to either side of flangeway gap 20 near traffic rail head regions B and C. The slope of surface 32 is in-part determined by the overall planform length of frog subassembly 30, and in some applications has a slope in the general range of from approximately 1 inch per 2 feet of running length to approximately one inch per 6 feet of running length in each frog subassembly running direction. Also, it should be noted that in the event filler element 34 of frog subassembly 30 requires replacement, a time-consuming and traffic-interrupting maintenance procedure involving unbolting and separation of traffic rails 18 and filler element 34 is required.

Figure 5:
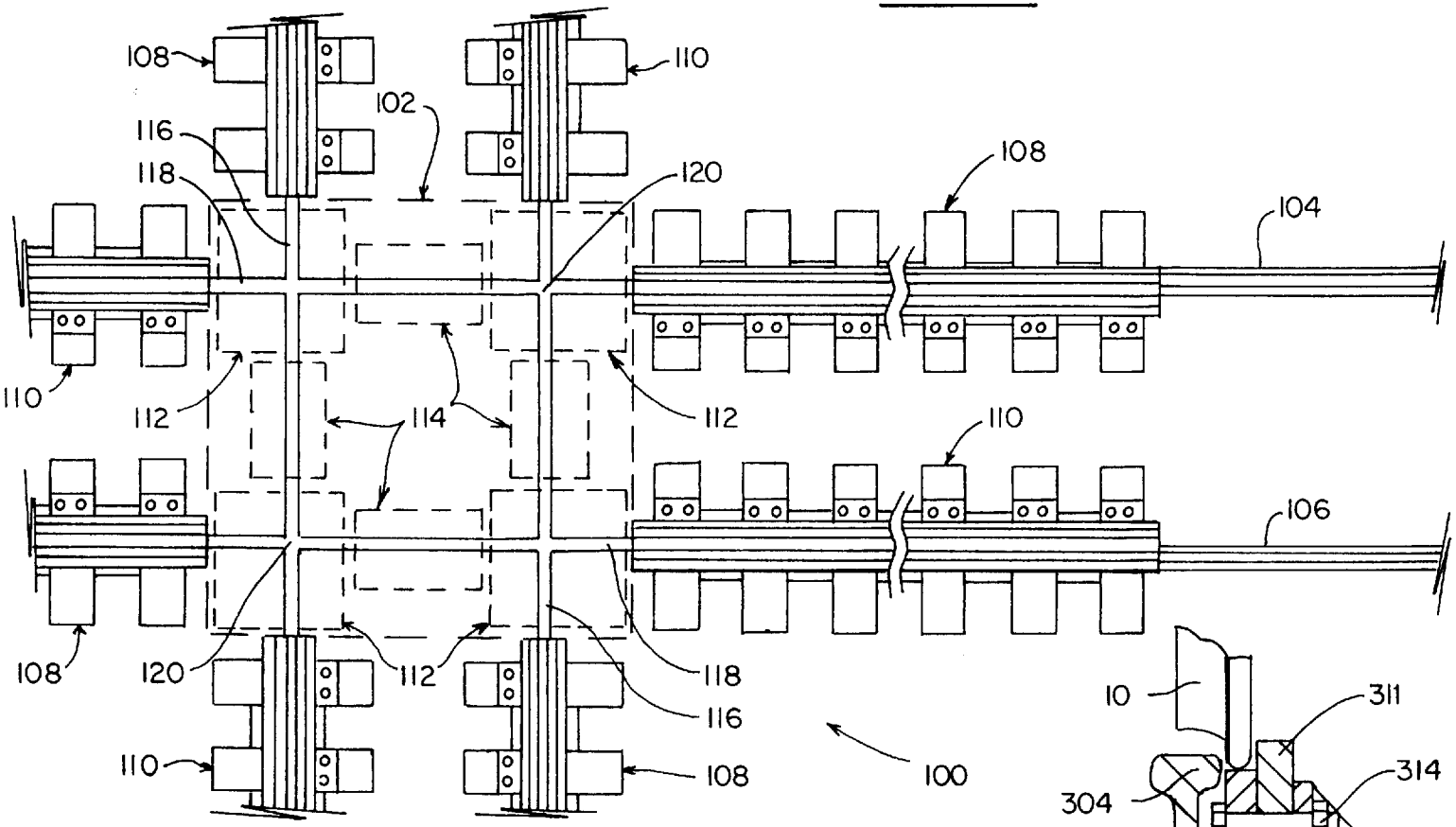
FIG. 5 is a schematic plan view of a preferred embodiment of the railroad trackwork intersection of the present invention utilized in a right-angled railroad crossing intersection application.
Figure 6:
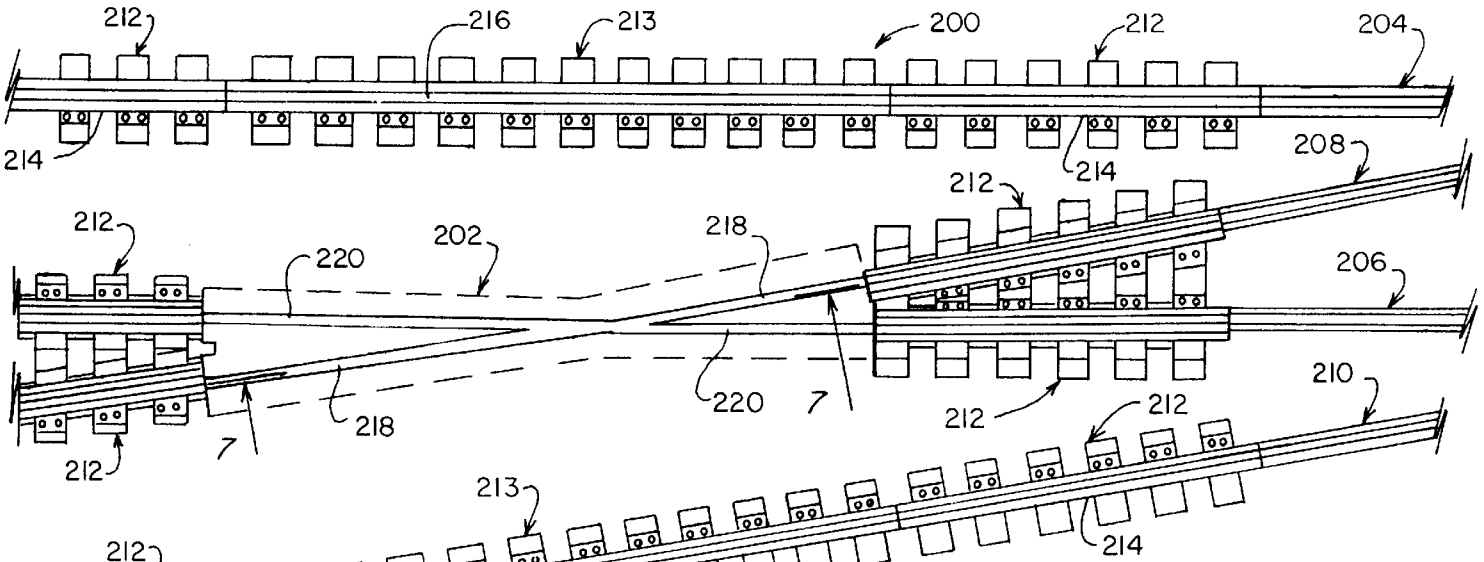
FIG. 6 is a schematic plan view of another embodiment of the railroad trackwork intersection of the present invention as utilized in a railroad turnout intersection application.

FIGS. 5 and 6 schematically illustrate a preferred embodiment of the present invention as applied to a railroad trackwork crossing intersection application (100) and to a railroad trackwork turnout intersection application (200), respectively.

Referring to FIG. 5, railroad trackwork right-angled crossing intersection 100 includes an interior intersection subassembly 102, paired trackwork mainline traffic rails 104 and 106, and paired easer subassemblies 108 and 110 that functionally co-operate with traffic rails 104 and 106 and with intersection subassembly 102. Subassembly 102 typically includes four different cast manganese steel frog subassembly elements 112 and may further include trackwork longitudinal filler section elements 114 that function to interconnect steel frog elements 112 in the event those frog elements are not sized or configured in planform to adjacently abut each other. It is important to note that intersection subassembly 102 has intersecting railcar wheel flangeways 116 and 118 which each have a flange-bearing flange support surface 120 (see FIG. 7) that is of uniform elevation throughout the planform extent of intersection subassembly 102. Flangeways 116 and 118 are essentially comprised of abutting flangeway segments included in co-operating frog elements 112 and filler section elements 114, if provided.

Referring to FIG. 6, the railroad trackwork turnout intersection referenced by the numeral 200 includes a single interior intersection frog element subassembly 202, paired trackwork mainline traffic rails 204 and 206, paired turnout traffic rails 208 and 210, easer subassemblies 212 that functionally co-operate with intersection inboard mainline and turnout traffic rails 206 and 208 and with frog element subassembly 202, and trackwork outboard guards 213 that each include a pair of easer subassemblies 214 separated by but joined to the intermediate trackwork longitudinal filler section subassembly designated as 216. It is important to note that intersection frog element subassembly 202 has intersecting railcar wheel flangeways 218 and 220 which each have a flange-bearing flange support surface 222 (see FIG. 7) that is of uniform elevation throughout the planform extent of intersection frog element subassembly 202. Also, trackwork guard assemblies 213 similarly each have, in their intermediate filler section 216, a flange-bearing flange support surface of uniform elevation throughout a running length that corresponds to and that is positioned opposite the planform running extent of railcar wheel flangeways 218 and 220.

Figure 7:
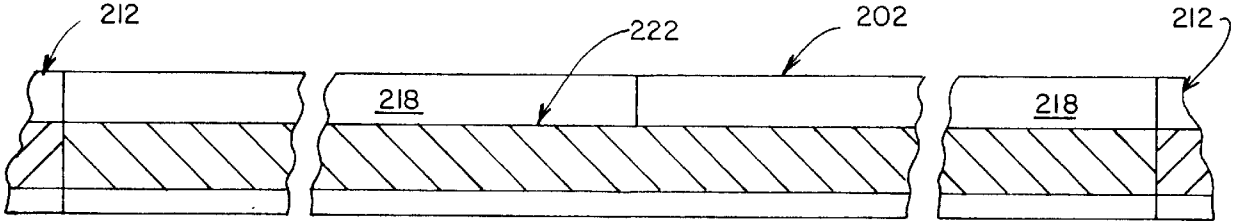
FIG. 7 is a section view taken at line 7—7 of FIG. 6.

The section view of FIG. 7 is provided in the drawings to illustrate more clearly the running extent of the flange-bearing flange support surface 222 that is provided in each of intersecting flangeways 218 and 220 of frog element subassembly 202. It should be noted that the support surface has a constant elevation relative to the subassembly base and a constant depth relative to the subassembly traffic rail head wheel tread support surface, both throughout the running or planform extent of subassembly 202.

FIGS. 8 through 11 essentially pertain to an easer subassembly embodiment 300 which may be preferred for utilization as the easer subassembly included in either crossing intersection 100 or turnout intersection 200, and FIGS. 12 through 17 pertain to an easer subassembly alternate embodiment 400 suitable for the same invention applications and also having the same easer bar sloped surface characteristics.

Figure 8:
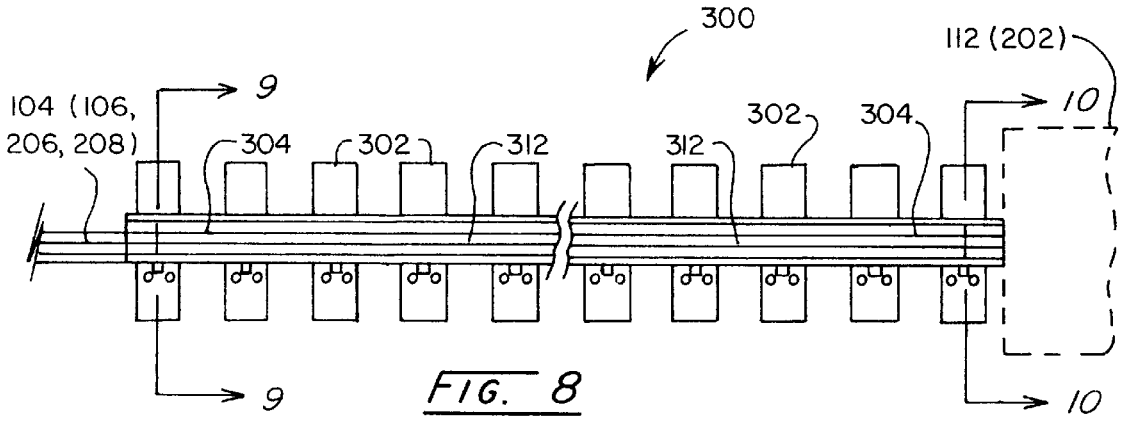
FIG. 8 is a plan view of a preferred form of easer subassembly advantageously utilized in the trackwork intersections of FIGS. 5 and 6.

Referring to FIG. 8, easer subassembly 300, as mounted on rigid base plate elements 302 adjacent traffic rail section 304, includes a series of spaced-apart riser plates 306 each normally edge-welded to a base plate 302, a series of cast braces 308 each welded and bolted to a riser plate 306, a guard rail section 310 supported upon riser plate 306, and an elevation-tapered easer bar element 312 also supported by riser blocks 306. A series of threaded bolt and nut fasteners 314 securely join easer bar element 312 and guard rail section 310 to cast braces 308 with an intermediate compliant interface spacer 316 being provided between elements 310 and 312 at each fastener location. Compliant interface spacers 316 preferably are molded of a thermosetting polyimide resin system reinforced with either embedded glass or carbon fibers. The spacer 316 also may be made of different materials such as ductile iron or steel.

Figure 9:
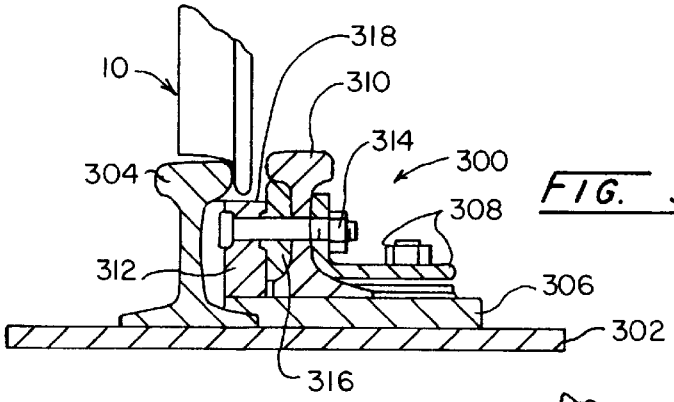
FIGS. 9 and 10 are section views taken at lines 9—9 and 10—10, respectively, of FIG. 8.
Figure 10:
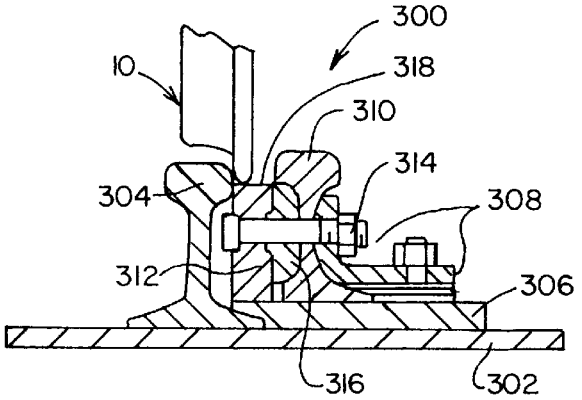

FIGS. 9 and 10 are section views taken at lines 9—9 and 10—10, respectively, of FIG. 8, and such illustrate the range of wheel flange-to-flange support surface elevation relationships that typically are developed as a railcar wheel 10 rolls over easer subassembly 300 between a traffic rail such as 104, 106 or 206, 208 abutting at one end of subassembly 300 and a frog subassembly element of either intersection subassembly 100 or 200. In order to minimize the impact loading imposed on the trackwork easer subassemblies we find it necessary to limit the sloping flange support surface 318 of tapered easer bar element 312 to a slope in the range of at least approximately 1 inch elevation change per 20 linear running feet but not greater than 1 inch elevation change per 10 running feet and preferably nearer the 1 inch per 20 feet slope value. Also, sloping flange-support surface 318 should have a total rise of at least approximately 1 inch, particularly for applications involving railroad trackworks constructed in accordance with AREA standards.

Figure 11:
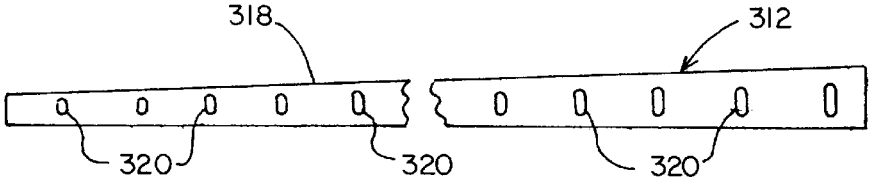
FIG. 11 is an elevation view of the easer bar element of the easer subassembly of FIGS. 8 through 10.

FIG. 11 illustrates the elevation configuration of tapered easer bar element 312 and more clearly shows, but in an exaggerated manner, the included sloping, flange support surface 318 of that element. In addition, FIG. 11 illustrates the elongated bolt holes 320 that are provided in easer bar element 312 for co-operation with bolt fasteners 314 of subassembly 300. Such elongated bolt hole arrangement facilitates a placement of shims between the under side of element 312 and riser blocks 306 at the several underside regions of support when subsequently making subassembly elevation adjustments to compensate for flange support surface wear. Such shimming action can be accomplished without having to disassemble the co-operating traffic rail.

Figure 12:
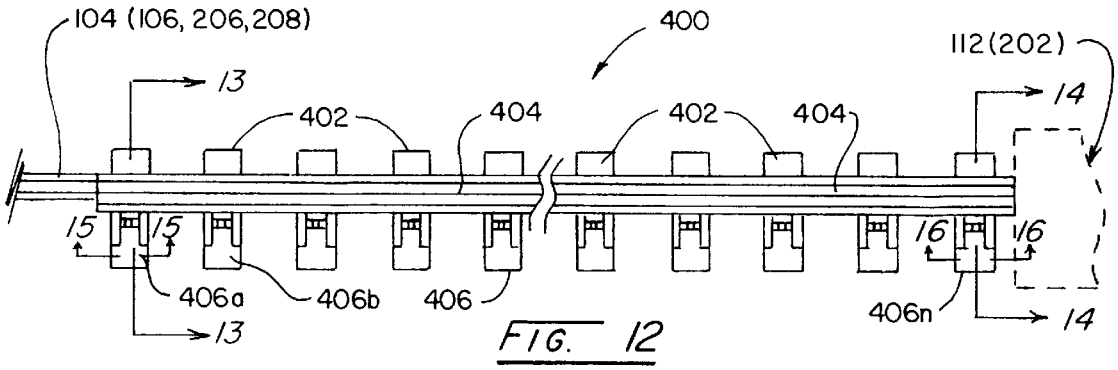
FIG. 12 is a plan view of another form of easer subassembly that may be utilized in the trackwork intersections of FIGS. 5 and 6.
Figure 13:
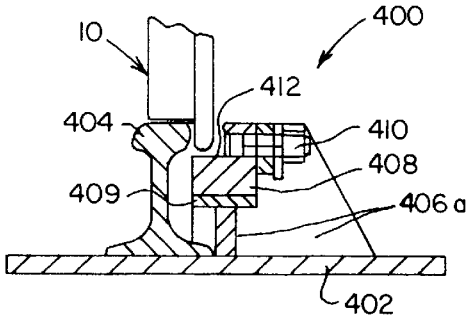
FIGS. 13 and 14 are section views taken at lines 13—13 and 14—14, respectively, of FIG. 12.
Figure 14:
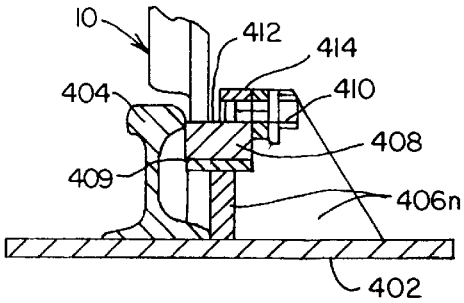
Figure 15:
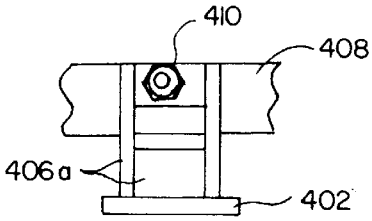
FIGS. 15 and 16 are elevation views taken at lines 15—15 and 16—16, respectively, of FIG. 12.
Figure 16:
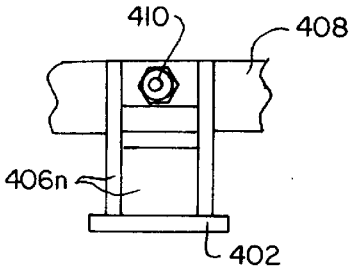

An alternate easer subassembly embodiment referenced as 400 in the drawings is illustrated in plan in FIG. 12 and in section in FIGS. 13 and 14 taken at lines 13—13 and 14—14, respectively, of FIG. 12. FIGS. 15 and 16 are respectively partial longitudinal elevation views taken at lines 15—15 and 16—16, respectively of FIG. 12.

Referring to FIG. 12, easer subassembly 400, includes rigid base plate elements 402 adjacent traffic rail section 404, a series of spaced-apart weldment struts 406*a* through 406*n* each of which is of a different overall height and is secured to a respective base plate 402 by edge welding, and an easer bar 408 supported by the weldment struts and secured in position by co-operating fasteners 410 which may be either a threaded bolt and nut type fasteners or elastic clip type fasteners. The heights of the individual weldment struts 406 are selected and controlled so that their support plate portions 409 which co-operate with the underside of easer bar 408 impart a slope to easer bar 408 which is in the range of the above-discussed 1 inch per 20 running feet to 1 inch per 10 running feet slope for flange-support surface 318 of easer subassembly 300.

Figure 17:
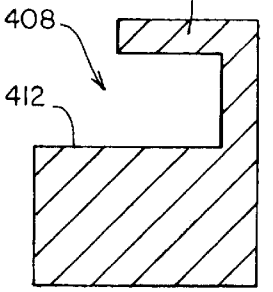
FIG. 17 is an enlarged section view of the easer bar component of the easer subassembly illustrated in FIGS. 12 through 16.

The preferred cross-section configuration for easer bar 408 is more clearly illustrated in FIG. 17. Easer bar element 408, which typically is machined from suitably-sized bar stock, is provided with a surface 412 which functions as a sloped flange-bearing flange support surface when installed in mounted weldment struts 406*a* through 406*n*. Such bar element is also provided with an integral guard flange 414 that functions in the manner of a conventional guard rail. The projection of integral flange 414 in part defines a recess in easer bar 414 into which the heads of fasteners 410 are positioned so as to not interfere with the easer bar guard function.

In the above general discussions of railroad trackwork intersection 100 we suggest the possible necessity of providing trackwork longitudinal filler sections 114 in the assembled intersection to assure continuity of the flange support surfaces of flange-bearing flangeways 116 and 118. In general, and if provided, such filler sections will have a construction and cross-section similar to one of the cross sections illustrated in FIGS. 10 and 14. In the one case, the included easer bar will not be tapered in the manner of easer bar 312 but will instead have a flange support surface of constant elevation that corresponds to the elevation of the uniform depth flangeways of frog element subassemblies 112. In the case of the FIG. 14 cross section, the trackwork longitudinal filler section will have weldment struts 406 that are all of the same height.

With respect to trackwork intersection 200 and the outboard trackwork guards 213, the included longitudinal trackwork filler sections that are longitudinally co-extensive with the frog element subassembly may have a cross-section corresponding to that of either FIG. 10 or FIG. 14, with either the included easer bar being non-tapered and thereby different than easer bar 312 or the subassembly weldment struts being of uniform height.

Figure 18:
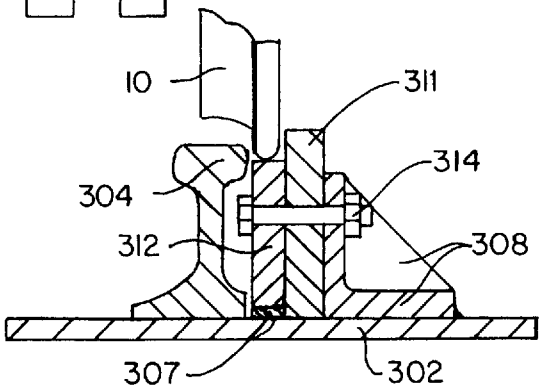
FIG. 18 is a section view similar to FIG. 10 but illustrating an alternate form of guard rail configuration and also an alternate arrangement of easer bar and guard rail support.

In FIG. 18 we schematically provide details of an advantageous modification to the trackwork intersection arrangement of FIGS. 8 through 10. Basically, guard rail 311, having a rectangular cross-section configuration, is substituted for conventionally configured guard rail element 310 and is supported directly by base plate 302 without an intervening riser block 306. Also, FIG. 18 illustrates a shim element 307 installed intermediate easer bar 312 and base plate 302 to compensate for previous excessive wear to the top surface of the easer bar. The FIG. 18 arrangement offers the additional advantage that guard rail 311 can be removed, inverted, and returned to its place or also removed, reversed lengthwise, and returned to its place, or both, to remedy excessive previous guard rail wear caused by prior repeated friction contact with the sides of wheel flanges of railcars traversing the intersection. Also, easer bar 312 may be inverted or sometimes be turned end-for-end and reinstalled to correct for excessive wear experienced in the easer bar upper flange-supporting surface.

Various changes with respect to shape, relative size, and materials of the specified construction components may be effected in the practice of the herein disclosed railroad trackwork intersection invention without departing from the meaning or spirit of the following claims.

We claim our invention as follows:

1. In a railroad trackwork intersection co-operating with a pair of railroad trackwork traffic rails and having intersecting traffic rail alignments, in combination:

a flange-bearing frog subassembly having intersecting railcar wheel flangeways that each have a flangeway wheel flange support surface of uniform elevation throughout the frog subassembly planform;

base plate means having a fixed position relative to said flange-bearing frog assembly;

a trackwork intersection traffic rail secured to said base plate means at a fixed position and in abutting relation to said flange-bearing frog subassembly;

an easer subassembly secured to said base plate means in abutting relationship to said flange-bearing frog subassembly, positioned parallel to said trackwork intersection traffic rail, and having a sloping railcar wheel flange support surface aligned parallel to said trackwork intersection traffic rail, said easer subassembly being secured to said base plate means wholly independently of said trackwork intersection rail, and said easer subassembly railcar wheel flange support surface abutting said flange-bearing frog subassembly flangeway wheel flange support surface, having a slope in the approximate range of from 1 inch rise for each 20 running feet to 1 inch rise for each 10 running feet, and having a rise of approximately 1 inch.

2. The invention defined by claim 1, wherein said easer subassembly comprises an easer bar element directly or indirectly supported by said base plate means, a guard rail element directly or indirectly supported by said base plate means, removable brace elements directly or indirectly supported by said base plate means, spacer elements separating said easer bar element from said guard rail element, and removable fastener means rigidly joining said easer bar, spacer, guard rail, and brace elements into a unitary structure, said easer subassembly railcar wheel flangeway wheel flange support surface being the upper surface of said easer bar element and being elevationally positioned below the upper surface of said guard rail element.

3. The invention defined by claim 2, wherein said spacer element is complementary and compliant relative to said easer bar element and said guard rail element.

4. The invention defined by claim 2, wherein said easer bar element is elevationally tapered throughout its running length.

5. The invention defined by claim 2, wherein said easer bar element is directly supported upon removable shims, said removable shims being positioned intermediate said easer bar element and said base plate means.

6. The invention defined by claim 1, wherein said easer subassembly comprises a series of spaced-apart support strut elements of progressively varying different heights and supported by and fixedly secured to said base plate means, an easer bar element removably supported by said spaced-apart support strut elements, and removable fastener means rigidly joining said easer bar element and said support strut elements into a unitary structure, said easer bar element having an upper surface portion that comprises said easer subassembly railcar wheel flangeway flange support surface.

7. The invention defined by claim 6, wherein said easer subassembly easer bar element is provided with a guard flange element, said guard flange element being positioned above said easer bar element first surface portion and separated by an integral recess which receives a portion of said removable fastener means.

8. The railroad trackwork intersection defined by claim 1 installed in a trackwork turnout, and further comprising a pair of outboard trackwork guard subassemblies which co-operate with intersection outboard traffic rails and which each have a pair of said easer subassemblies co-operably connected to an intermediate longitudinal trackwork filler section, said trackwork filler sections each having a railcar wheel flangeway flange support surface of uniform elevation throughout a planform extent that is coextensive the planform extent of said flange-bearing frog subassembly railcar wheel flangeways.

9. The invention defined by claim 1, wherein said easer subassembly comprises an easer bar element directly or indirectly supported by said base plate means, a guard rail element directly or indirectly supported by said base plate means, removable brace elements directly or indirectly supported by said base plate means and removable fastener means rigidly joining said easer bar, guard rail, and brace elements into a unitary structure, said easer subassembly railcar wheel flangeway wheel flange support surface being the upper surface of said easer bar element and being elevationally positioned below the upper surface of said guard rail element.

10. The railroad trackwork intersection defined by claim 9 wherein said guard rail element has a rectangular cross sectional configuration.

11. The railroad trackwork intersection defined by claim 9 wherein said easer bar element is directly supported upon removable shims, said removable shims being positioned intermediate said easer bar element and said base plate means.

* * * * *